United States Patent [19]

Wallace et al.

[11] Patent Number: 4,879,814

[45] Date of Patent: Nov. 14, 1989

[54] METHOD AND APPARATUS FOR BORESIGHT ALIGNMENT OF ARMORED BATTLEFIELD WEAPONS

[75] Inventors: Barry M. Wallace; Ross Fasolino, both of Garland, Tex.

[73] Assignee: Texas Instruments Incorporated, Dallas, Tex.

[21] Appl. No.: 92,020

[22] Filed: Aug. 28, 1987

[51] Int. Cl.[4] ..... G01B 11/26

[52] U.S. Cl. ..... 33/234; 33/DIG. 21; 356/153

[58] Field of Search ..... 33/234, 286, DIG. 21; 356/153, 138

[56] References Cited

U.S. PATENT DOCUMENTS

| | | | |
|---|---|---|---|
| 2,294,913 | 9/1942 | Kaufman et al. | 33/234 |
| 2,773,309 | 12/1956 | Elliott | 33/234 |
| 3,711,204 | 1/1973 | Steck, III | 33/234 X |
| 3,782,832 | 1/1974 | Hacskaylo | 33/234 |
| 3,920,335 | 11/1975 | Seehase | 33/234 X |
| 4,676,636 | 6/1987 | Bridges et al. | 356/153 |

FOREIGN PATENT DOCUMENTS

| | | | |
|---|---|---|---|
| 2069105 | 8/1981 | United Kingdom | 33/234 |

*Primary Examiner*—Harry N. Haroian
*Attorney, Agent, or Firm*—Rene E. Grossman; Ferdinand M. Romano; Melvin Sharp

[57] ABSTRACT

The disclosure relates to a boresight unit wherein an electro-optic package is disposed in a gun shell casing and loaded into the breach end of the main gun tube of a tank for use in boresighting visible or thermal gunsights. The package includes a laser aligned with the axis of the shell and main gun tube as well as an optical system for controlling the size of the light beam emanating from the laser. The gun is aligned by placing the boresight unit in the gun breech, making the appropriate adjustments to the gun and then replacing the boresight unit with a live shell.

7 Claims, 3 Drawing Sheets

STEP - 1

STEP - 2

METHOD AND APPARATUS FOR BORESIGHT ALIGNMENT OF ARMORED BATTLEFIELD WEAPONS

BACKGROUND OF THE INVENTION

1. FIELD OF THE INVENTION

This invention relates to a device for boresighting guns and the like and, more specifically, to a device for boresighting guns for use in conjunction with tanks, though the use thereof in other environments is contemplated.

2. BRIEF DESCRIPTION OF THE PRIOR ART

Current boresighting devices and procedures on armored vehicles are costly, inconvenient and often present situations of extreme peril.

Prior to the use of the presently used Pi-Watson device, boresighting of a gun was accomplished by first taping thread over the end of the gun tube to form a crosshair. The firing pin assembly was then removed from the breech of the gun and the gun loader peered through the gun tube with a pair of binoculars and "talked" the gunner onto a 1200 meter distant target wherein the cross hairs were on the target as viewed through the binoculars. "Zeroing" of the gun was then accomplished by firing a group of three rounds or shots through the target with the gunner then re-aligning the gun sights to the center of the shot group.

Boresighting of U.S. military tank gunsights was improved and is currently accomplished by use of an instrument known as a Pi-Watson device. In order to use this instrument for gun alignment the gun loader of the tank must exit the vehicle and place the Pi-Watson device into the end of the main gun tube. The loader must then be hoisted to the level of the device side eyepiece and look through the side eyepiece into the device. To accomplish this, the loader must generally find something to stand on. While looking through the eyepiece, the loader sees a crosshair and a selected 1200 meter distant target. The 1200 meter target must have a sharp angle for proper alignment of the crosshairs. The loader must then "talk" the gunner onto the target using up, down, left and right commands as in the older art. The gunner then moves the gun according to the commands until the loader advises that the gun is on target. At that time, the loader will have the target in the right lower quadrant on the cross hairs. The loader then removes the Pi-Watson device from the tube, rotates it 180 degrees and places it back into the gun tube. The alignment process is then repeated.

Problems inherent in the Pi-Watson system are that the loader must exit the tank for gun alignment, thereby exposing himself to fire under combat. In addition, the Pi-Watson device is expensive and the procedure required for alignment is long and cumbersome. Furthermore, on occasion, especially due to the exigencies of combat, personnel have forgotten to remove the Pi-Watson device from the gun tube, thereby causing great damage to gun and calibration instrument upon firing the next shot.

It would be desirable from the point of view of a tank commander to have a boresighting tool that could be used with such ease and speed that a boresight performance check can be made on each occasion just prior to entering a battle situation and possibly during lulls in the battle situation itself wherein the inherent dangers to the personnel are minimized.

SUMMARY OF THE INVENTION

In accordance with the present invention, the above problems inherent in the prior art are minimized and there is provided a relatively inexpensive, easily and quickly operated system for gun alignment which can be operated without the necessity of the loader or operator leaving the tank.

Briefly, in accordance with the present invention, there is provided an electro-optic package which is placed in a shell casing of the caliber suitable for the gun under test. The casing with package therein is loaded into the breech end of the main gun tube of a tank.

The electro-optic package includes a power supply for driving a laser, the power supply deriving its power either from a battery or, preferably, from the tank electrical system power supply. The laser is prealigned within the casing so that it directs its light beam along the axis of the gun tube. This alignment takes place at the time of manufacture of the boresight unit by appropriate adjustment of an alignment and support structure within the casing to which the laser is secured. Once the laser is properly aligned, the requirement for later adjustment thereof is minimal. The output of the laser is passed through a lens system which is designed to provide a spot of light emanating from the casing which is preferably two inches in diameter at the target. The lens system is adjusted at the time of manufacture to provide the desired size light spot, this adjustment being accomplished by calculation, taking into account the lenses being utilized. Once the lenses have been properly installed within the casing, the requirement for later adjustment thereof is also minimal.

The manner of operation of the alignment system of the present invention is to load the casing with electro-optical package therein into the breech of the gun under test. When the gun is fired, the laser will emit a light beam which the gunner will spot on the 1200 foot distant target. Adjustments of the gun position will then be made with continual firings until the light beam is on target. At this point, the gunner will program into his system the appropriate numbers obtained for an on-target condition, the casing is removed from the breech of the gun and the gun is now ready for accurate operation.

DESCRIPTION OF THE PREFERRED EMBODIMENT

Figure 1:
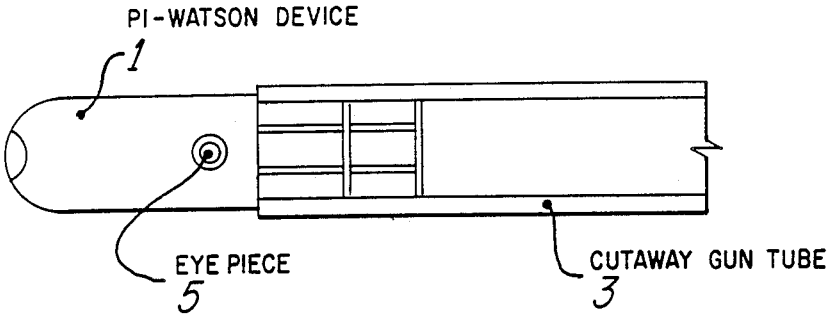
FIG. 1 is a schematic diagram of a prior art Pi-Watson device loaded into the end of a gun tube.
Figure 2:
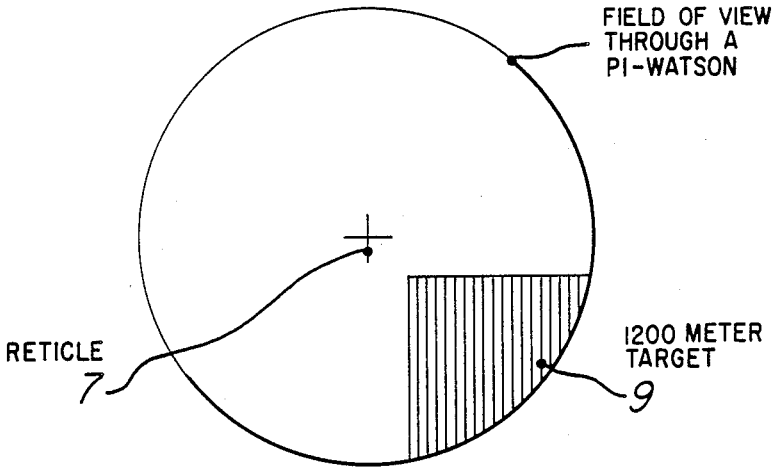
FIG. 2 is a diagram of the field of view through a slightly off-center Pi-Watson device.
Figure 3:
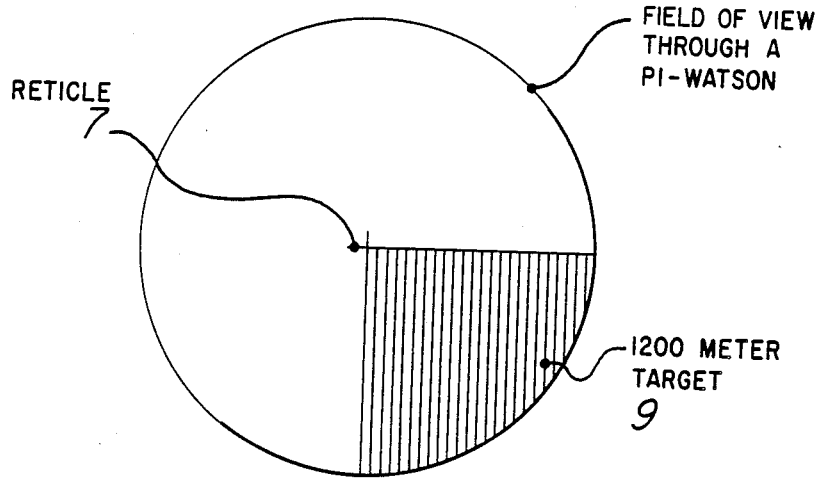
FIG. 3 is a diagram as in FIG. 2 with the device on target.

Referring first to FIG. 1, there is shown the prior art Pi-Watson device 1 secured in a gun tube 3. The eyepiece 5 is disposed in the side of the device 1 for viewing by an operator or loader. In operation, the operator must be in a position to look through the eyepiece 5 at a target 1200 meters away. The operator will view a reticle 7 as shown in FIGS. 2 and 3 which is a part of the optical system (not shown) of the device 1 relative to the target 9. As viewed in FIG. 2, the operator will call to the gunner to move the gun tube up and to the left to approach the target 9. This will continue to be done until such time as the operator observes that the gun tube is on target as shown in FIG. 3. At that time the gun is assumed to be properly aligned and ready for use. It is apparent, as noted above, that the operator must exit the tank to reach the end of the gun tube 3, thereby being exposed to gunfire when in combat. In addition, the operator must be elevated to the level of the eyepiece which can be more elevated than the eye of an ordinary person, this possibly requiring that an assistant also exit the tank and be exposed. Furthermore, due to the dangers involved due to exposure to fire external of the tank and the complexities involved in calibration with a Pi-Watson device, it is substantially impossible to recalibrate or realign the gun during battle except on a "seat of the pants" basis.

Figure 4:
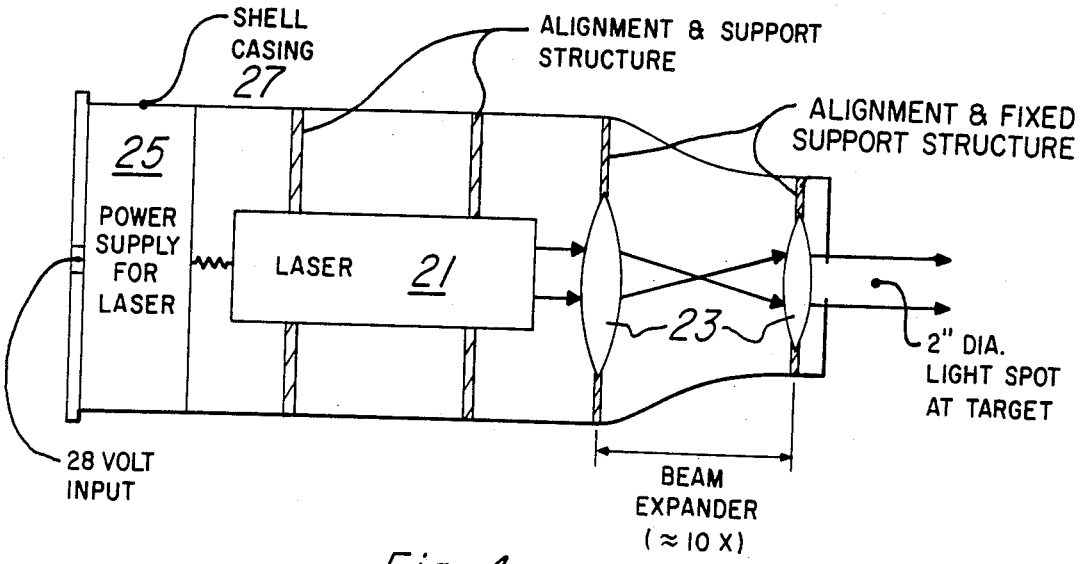
FIG. 4 is a schematic diagram of a boresight alignment unit in accordance with the present invention.

Referring now to FIG. 4, there is shown the system in accordance with the present invention which overcomes the above described problems of the prior art. The system comprises an electro-optic package containing a laser head 21, which can be in the visible or infrared frequency range, beam expansion optics 23 shown as a pair of lenses and a laser power supply 25 which is fitted into an empty shell casing 27 and fed with power external of the casing, preferably from the tank electrical system. The laser provides a source of light which is intense and has a low divergence characteristic. The beam expander is necessary to provide control of the size of the projected laser beam at a selected range. As stated above, the laser power supply is placed inside the shell casing with the laser head for convenience, but it should be understood that the power supply could be located externally thereof.

To be used for boresight, the electro-optical package is placed into the breech end of the main gun of a tank. A shell is normally held securely in the breech, therefore, no angular pointing error is present.

When the gunner places the main gun on "fire" and squeezes the trigger, with the power supply voltage (28 volts herein) applied to the power supply, the laser fires down the gun tube. At the target, a circle of laser light (visible or infrared) will appear.

The angular resolution capability of the human eye is approximately one arc minute (0.0167 degrees). If the gunsight has a magnification factor of eight, a target 2 inches in diameter would be visible at a distance of 1200 meters. (A smaller spot may be detected, however the contrast required will be much greater.) The laser beam radius at the target is given by $$W(Z)^2 = W(0)^2 \times [1 + (\lambda Z/\pi W(0)^2)^2]$$

where Z is the range to the target, W(0) is the beam radius at the output of the beam expander and (λ) is the laser wavelength. For a HeNe laser, the output beam radius will have to be 1.044 cm. to have a 2 inch laser spot at 1200 meters. This size will easily fit in the shell casing. For $CO_2$, a 2 inch diameter spot is not easily obtained at a range of 1200 meters. The minimum spot radius is approximately 9 cm. with a 6 cm. radius output beam radius. This will probably not fit in the shell casing, but since output power is not a severe limitation for the $CO_2$ laser, a compromise between output beam radius and target spot size can be made, a larger beam radius requiring an increase in laser power.

The target can be essentially any flat surface that has good reflectivity of the laser wavelength. Examples of appropriate targets are stucco walls, large rocks, buildings, other vehicles, etc.

Once a satisfactory target has been chosen at an approximate range of 1200 meters, the superelevation is removed from the gun. The loader then loads the boresighting round into the breech in place of a normal round and places the gun into the firing mode. The gunner then places his selector switch to fire and squeezes the trigger. The gunner then adjusts the gunsight reticle to be centered on the laser spot. Use of this device permits a tank crew to reconfirm boresight of the main gun only minutes before every battle as well as, possible, during lulls in a battle.

The above noted device, while disclosed herein with respect to use in conjunction with the main gun of a tank, can be used with any type of gun which is capable of being aligned with a target.

Figure 5A:
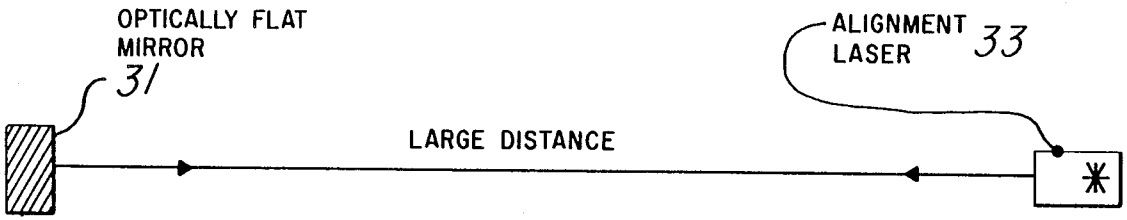
FIGS. 5*a* and 5*b* are schematic diagrams showing the procedures required in aligning the boresight unit in accordance with the present invention.
Figure 5B:
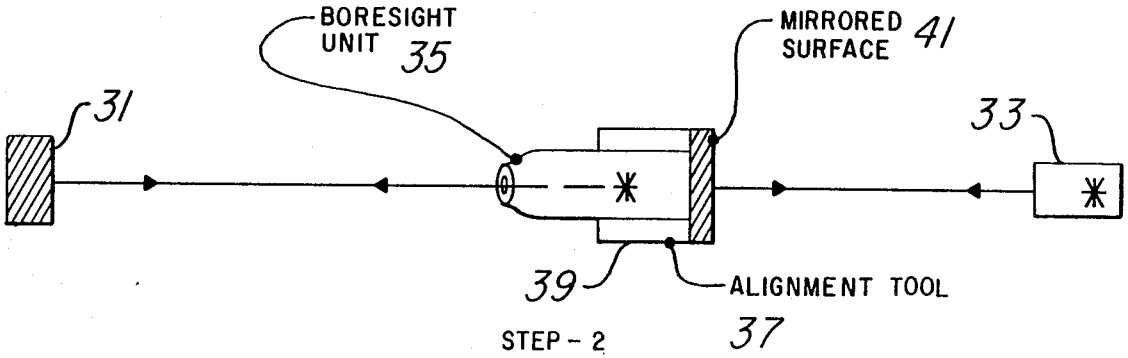

Alignment of the boresight unit itself is performed at an alignment station with the use of special equipment. Initially, the optical surface of a reference mirror 31 of FIG. 5(*a*) is positioned orthogonal to the line of sight of an alignment laser 33 using an autoreflection technique. The mirror is located a large distance from the laser for best accuracy. Next, the boresight unit 35 is placed in the line of sight of the alignment laser 33. An alignment tool 37 comprising a ring assembly 39 and a mirrored surface 41, which are machined to close tolerance for orthogonal fit, is placed around the boresight unit 35. The boresight unit 35 and alignment tool 37 are positioned orthogonal to the alignment laser 33 line of sight via the aforementioned autoreflection technique. The alignment tool mirrored surface 41 is then parallel to the original reference mirror 31. The boresight laser (21 of FIG. 4) is then energized and autoreflection is used to adjust the laser 21 to the original alignment laser line of sight.

It should be understood that the above noted alignment procedure for the boresight is only a preferred embodiment therefore, many other procedures being equally applicable.

Critical to the performance of the boresight unit (FIG. 4) is the ability of the gunner to observe the laser light on the target. For a thermal sight, this is directly related to the amount of reflected IR laser energy from the target and the sensitivity of the thermal sensor used in the sight. Dimensionally small, high powered carbon dioxide lasers are available which are capable of providing sufficient laser power to meet almost any requirement of boresight. Concentration of this section will therefore be on the power requirements for visible lasers.

The main difficulty in observing a visible laser spot on a target is competition with sunlight. The Weber fraction (see, for example, "Digital Image Processing" by Pratt, page 32) establishes that the necessary contrast (delta I/I) between two areas, one with intensity I and the other with intensity I + delta I, for detection by the human is approximately 2 percent. Hence, the laser spot must appear 2 percent brighter than a sun illuminated target.

For the purpose of the present analysis, a worst case situation is assumed of a perfectly white diffuse surface illuminated fully by the sun. Response to all wavelengths of visible light is uniform. The laser spot is assumed to be 2 inches in diameter at a distance of 1200 meters. Atmospheric conditions are assumed to have no impact on the analysis.

Table I lists the solar irradiance at sea level for an area normal to the sun (from the CRC "Handbook of Chemistry and Physics", 56th Edition). The data listed is in units of irradiance (watts per square meter) and must be converted to photometric units to account for the response of the human eye in the analysis.

Radiometric units can be converted to photometric units using the equation $$Ev = F \times Ee$$

where, Ev is the photometric illuminance (lumens per meter squared), Ee is the radiometric irradiance (watts per meter squared) and F is the conversion factor given by $$F = 680 \frac{\int K(\lambda)\, Ee(\lambda)\, d\lambda}{\int Ee(\lambda)\, d\lambda} \text{ (lumens/watt)}$$

where K(λ) is the relative visibility factor of the human eye. The values for K(λ) are listed in Table II (from "Principles of Optics" by Born and Wolf). The peak human response is at 0.555 micron.

Performing the indicated calculations result in a conversion factor value of F = 207.089 (lumens/watt) and a resultant illuminance of Ev = 85664.244 lumens per meter squared.

In view of the requirement that the laser spot be 2 percent brighter than the reflected sunlight, the necessary laser illiminance is EL = 87377.53 lumens per meter squared. The normal specification for lasers is, however, in terms of radiometric quantities. If the laser wavelength chosen for use is 0.6328 micron (HeNe), the required laser irradiance is given by $$\begin{aligned} Ee(0.6328) &= (1/680) \times (1/0.2398) \times Ev \\ &= 535.85 \text{ watts per meter squared} \end{aligned}$$

If the laser spot is 2 inches in diameter then the spot area is A = 20.27 square centimeters and the required laser power is given by $$\begin{aligned} P(0.6328) &= A \times EL(0.6329) \\ &= 1.086 \text{ watts} \end{aligned}$$

This is a large amount of energy for a HeNe laser and is currently beyond the state of the art, but is envisioned as a part of the invention herein in the event the art of HeNe lasers advances to make them practical herein.

The argon ion laser is a commercially available visible laser with moderately high output power. A weighted average wavelength for the laser is 0.5 micron. The relative visibility factor for 0.5 micron is 32.3 percent, only slightly better than that for the HeNe wavelength. The required laser power at this wavelength is given by $$\begin{aligned} P(0.5) &= A \times (1/680) \times (1/0.323) \times EL \\ &= 0.81 \text{ watts} \end{aligned}$$

This power requirement is easily achieved by commercial lasers.

If a laser with an output wavelength of 0.555 micron were used, the relative visibility factor would be 1.0. Hence, the required laser power is given by $$\begin{aligned} P(0.555) &= A \times (1/680) \times EL \\ &= 0.260 \text{ watt} \end{aligned}$$

This is a modest amount of power.

It should be emphasized at this point that the actual required laser powers may be less than calculated above due to the assumption that the target is fully illuminated by sunlight and that specular reflection of the laser light has not been included.

It is therefore readily apparent that the use of an empty shell casing to hold the electro-optic package in accordance with the present invention is efficient in that empty shell casing are readily available, requiring no special design to fit the gun breech at low cost. These casings are easy to store in the vehicle and provide an extraordinary amount of protection for the optics.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modification.

We claim:

1. A method of aligning a gun comprising the steps of:

(a) providing a boresight device in a shell casing having an aligned laser therein, said laser being aligned by
  (1) providing an optically flat mirror;
  (2) aligning an alignment laser so that the light beam emanating therefrom is normal to the flat surface of said mirror;
  (3) providing an alignment tool having a mirrored surface and securing said boresight device so that the axis of said device is normal to said mirrored surface;
  (4) adjusting said mirrored surface to be normal to the light beam emanating from said alignment laser, and
  (5) adjusting the aligned laser so that a light beam emanating therefrom is normal to the flat surface of said optically flat mirror;

(b) placing the shell in the breech of a gun to be aligned;

(c) projecting a beam of light from the aligned laser toward a target; and (d) adjusting the gun to project the beam onto the target.

2. The method of claim 1 wherein the ratio of the diameter of the beam projected in step (c) to the distance of said target from said laser is approximately 2 inches to 1200 meters.

3. The method of claim 1 further including the step of reloading said breech with a live shell.

4. A boresight device, which comprises, in combination:

(a) a gunshell;

(b) a laser aligned with the major axis of said gun shell and disposed within said gunshell for providing a light beam along said axis;

(c) an optical system within said gunshell for controlling the size of the light beam emanating from said laser; and (d) means within said gunshell for adjusting the position of at least one of said laser and said optical system.

5. A boresight device as set forth in claim 4 wherein said boresight device further includes a power supply positioned in said gunshell.

6. A boresight device as set forth in claim 4 wherein said laser is an argon ion laser.

7. A boresight device as set forth in claim 5 wherein said laser is an argon ion laser.

* * * * *